US009057282B2

(12) United States Patent
Chillar et al.

(10) Patent No.: US 9,057,282 B2
(45) **Date of Patent: *Jun. 16, 2015**

(54) SYSTEMS AND METHODS FOR ADJUSTING CLEARANCES IN TURBINES

(75) Inventors: Rahul J. Chillar, Atlanta, GA (US); Erwing Calleros, Atlanta, GA (US); Prabhakaran Saraswathi Rajesh, Bangalore, IN (US); Ezio Pena, Belfort (FR); Nicolas Antoine, Montreux-Vieux (FR); Jose-Quintino Da-Costa, Pont de Roide (FR)

(73) Assignee: General Electric Company, Schenectady, NY (US)

( * ) Notice: Subject to any disclaimer, the term of this patent is extended or adjusted under 35 U.S.C. 154(b) by 714 days.

This patent is subject to a terminal disclaimer.

(21) Appl. No.: 13/302,372

(22) Filed: Nov. 22, 2011

(65) Prior Publication Data

US 2013/0129470 A1 May 23, 2013

(51) Int. Cl.
*F01D 11/24* (2006.01)

(52) U.S. Cl.
CPC ..... *F01D 11/24* (2013.01)

(58) Field of Classification Search
CPC ..... F01D 11/24; F01D 11/20; F01D 11/14; F01D 11/08
USPC ..... 415/1, 14, 47, 108, 114, 118, 134, 136, 415/173.1, 173.2, 177, 178, 196, 197, 217.1
See application file for complete search history.

(56) References Cited

U.S. PATENT DOCUMENTS

| | | | | |
|---|---|---|---|---|
| 5,630,702 | A * | 5/1997 | Marmilic et al. | 415/177 |
| 2002/0055330 | A1 * | 5/2002 | Schroeder et al. | 454/252 |

FOREIGN PATENT DOCUMENTS

| | | | | |
|---|---|---|---|---|
| CN | 1854468 | A | 11/2006 | |
| CN | 101078356 | A | 11/2007 | |
| DE | 102006012977 | * | 10/2007 | F01D 25/08 |
| EP | 1777373 | A1 * | 4/2007 | F01D 11/24 |
| JP | 8210106 | A | 8/1996 | |
| JP | 2000286463 | | 10/2000 | |
| JP | 2007077990 | A | 3/2007 | |
| WO | 2007032803 | | 3/2007 | |

OTHER PUBLICATIONS

Chinese Office Action dated Apr. 3, 2015 for Application No. CN 201210461959.6.

* cited by examiner

*Primary Examiner* — Edward Look
*Assistant Examiner* — Juan G Flores
(74) *Attorney, Agent, or Firm* — Sutherland Asbill & Brennan LLP

(57) ABSTRACT

Embodiments of the invention can provide systems and methods for adjusting clearances in a turbine. According to one embodiment of the invention, there is disclosed a turbine system. The system may include one or more turbine blades; a turbine casing encompassing the one or more turbine blades; and a thermoelectric element disposed at least partially about the turbine casing, wherein the thermoelectric element expands or contracts the turbine casing by heating or cooling at least a portion of the turbine casing, thereby adjusting a clearance between the one or more turbine blades and the turbine casing.

15 Claims, 4 Drawing Sheets

SYSTEMS AND METHODS FOR ADJUSTING CLEARANCES IN TURBINES

FIELD OF THE INVENTION

Embodiments of the invention relate generally to turbines, and more particularly to systems and methods for adjusting clearances in turbines.

BACKGROUND OF THE INVENTION

Turbine blades and turbine casings may expand or contract during startup and operation of a turbine due to the thermal state of the turbine. Accordingly, a clearance between the turbine blades and the turbine casing may vary due to the expansion and contraction of the turbine blades and turbine casing. Generally, the smaller the clearance between the turbine blades and the turbine casing, the greater the efficiency of the turbine during operation. Moreover, the larger the clearance between the turbine blades and the turbine casing, the faster the startup of the turbine.

BRIEF DESCRIPTION OF THE INVENTION

Some or all of the above needs and/or problems may be addressed by certain embodiments of the invention. Disclosed embodiments may include systems and methods for adjusting clearances in turbines. According to one embodiment of the invention, there is disclosed a turbine system. The system may include one or more turbine blades; a turbine casing encompassing the one or more turbine blades; and a thermoelectric element disposed at least partially about the turbine casing, wherein the thermoelectric element expands or contracts the turbine casing by heating or cooling at least a portion of the turbine casing thereby adjusting a clearance between the one or more turbine blades and the turbine casing.

According to another embodiment of the invention, there is disclosed a method for adjusting clearances in a turbine, the turbine comprising a turbine casing encompassing one or more turbine blades, the method comprising: positioning one or more thermoelectric elements at least partially about the turbine casing; and controlling the expansion or contraction of the turbine casing by heating or cooling at least a portion of the turbine casing with the one or more thermoelectric elements, wherein a clearance between the one or more turbine blades and the turbine casing is adjusted.

Further, according to another embodiment of the invention, there is disclosed another turbine system. The system may include one or more turbine blades; a turbine casing encompassing the one or more turbine blades; at least one thermoelectric element disposed at least partially about the turbine casing; and a controller in communication with the at least one thermoelectric element. The controller can include a computer processor; and a memory in communication with the computer processor operable to store computer-executable instructions. The computer-executable instructions can be operable to control the expansion or contraction of the turbine casing by heating or cooling at least a portion of the turbine casing with the at least one thermoelectric element, wherein a clearance between the one or more turbine blades and the turbine casing is adjusted.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE INVENTION

Illustrative embodiments of the invention will now be described more fully hereinafter with reference to the accompanying drawings, in which some, but not all embodiments of the invention are shown. The invention may be embodied in many different forms and should not be construed as limited to the embodiments set forth herein; rather, these embodiments are provided so that this disclosure will satisfy applicable legal requirements. Like numbers refer to like elements throughout.

Illustrative embodiments of the invention are directed to, among other things, systems and methods for adjusting clearances in a turbine. Certain illustrative embodiments of the invention may be directed to a thermoelectric element disposed about at least a portion of a turbine casing for expanding or contracting the turbine casing by heating or cooling at least a portion of the turbine casing thereby adjusting a clearance between one or more turbine blades and the turbine casing.

In some embodiments, the thermoelectric element may comprise a Peltier element disposed between a cold sink and a heat sink. A voltage may be applied to the Peltier element to control heat transfer between the cold sink and the heat sink. The cold sink and the heat sink may be dependent on the polarity of the applied voltage to the Peltier element. In some aspects, the cold sink and the heat sink may comprise ceramic plates. In other aspects, the heat sink may be in communication with a ventilation system. In still other aspects, the thermoelectric element may be disposed circumferentially about at least a portion of the turbine casing in line with the one or more turbine blades.

Certain embodiments of the invention can provide a technical solution to adjusting clearances between one or more turbine blades and the turbine casing. In one embodiment, the clearance between the one or more turbine blades and the turbine casing may be reduced to increase efficiency during operation. In this manner, the turbine casing may be cooled to contract it about the one or more turbine blades. In another embodiment, the clearance between the one or more turbine blades and the turbine casing may be increased to increase efficiency during startup and increase the speed of the startup. In this manner, the turbine casing may be heated to expand it about the one or more turbine blades to allow the one or more turbine blades to expand during startup. In yet another embodiment, the clearance between the one or more turbine blades and the turbine casing may be adjusted to increase efficiency during transitions.

Figure 1:
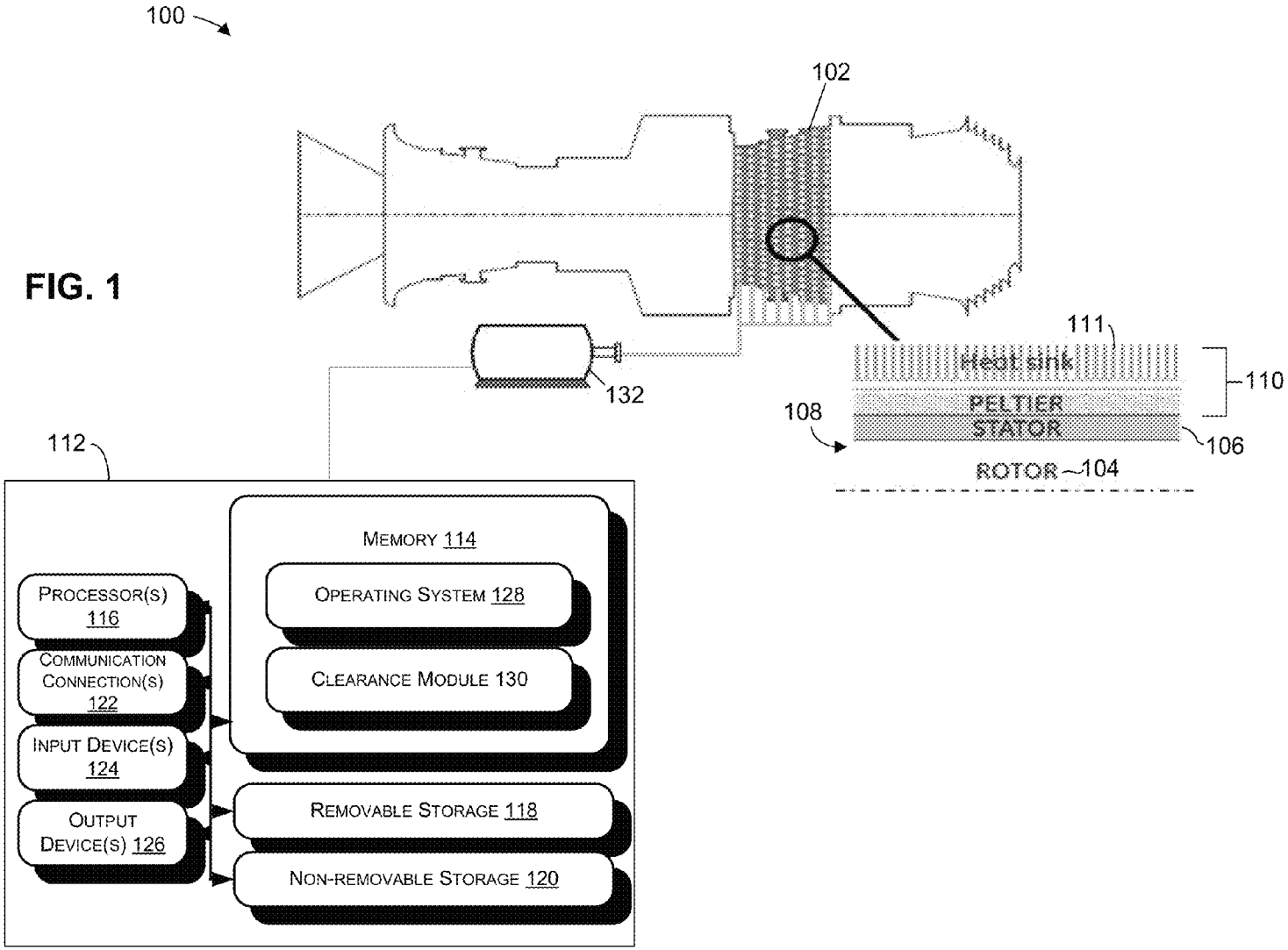
FIG. 1 is a schematic illustrating an example turbine system including a block diagram of a computer environment for adjusting clearances in the turbine, according to an embodiment of the invention.

FIG. 1 provides an example turbine system 100 illustrating details for adjusting clearances in a turbine 102. The turbine 102 may include one or more turbine blades 104 (or rotors). The turbine 102 may also include a turbine casing 106 (or stator) such that the turbine casing 106 encompasses the one or more turbine blades 104. The one or more turbine blades 104 generally rotate about a center axis of the turbine 102. The turbine 102 may include a clearance 108 between the distal ends of the one or more turbine blades 104 and the inner radius of the turbine casing 106.

The turbine system 100 may include a thermoelectric element 110 disposed at least partially about the turbine casing 106. In certain embodiments, the thermoelectric element 110 may be disposed at least partially about the turbine casing in line within the turbine blades 104. The thermoelectric element 110 may heat or cool a portion of the turbine casing 106 in communication with the thermoelectric element 110. The heating and cooling of the turbine casing 106 by the thermoelectric element 110 may expand or contract at least a portion of the turbine casing 106, respectively. The expansion and contraction of the turbine casing 106 adjusts the clearance 108 between the one or more turbine blades 104 and the turbine casing 106. One or more thermal sensors may be disposed on or about the turbine casing, the one or more turbine blades, and/or any other location on or about the turbine to monitor the turbine system 100.

In certain embodiments, the thermoelectric element 110 may include a heat sink 111 for dissipating heat from the thermoelectric element 110. The heating or cooling of the one or more thermoelectric elements 110 is dependent on a voltage and polarity received from a power source 132. For example, the heat sink 111 may be a heat sink or a cold sink depending on the polarity of the power source received by the thermoelectric element 110. Accordingly, whether the thermoelectric element is in a heating mode or a cooling mode is dependent on the polarity of the power source 132.

Still referring to FIG. 1, in certain illustrative embodiments, the turbine system 100 may include a controller device 112 for adjusting the clearance between the one or more turbine blades 104 and the turbine casing 106. The controller device 112 may be configured as any suitable computing device capable of implementing the disclosed features, and accompanying methods, such as, but not limited to, those described with reference to FIG. 4. By way of example and not limitation, suitable computing devices may include personal computers (PCs), servers, server farms, data centers, or any other device capable of storing and executing all or part of the disclosed features.

In one illustrative configuration, the controller device 112 comprises at least a memory 114 and one or more processing units (or processor(s)) 116. The processor(s) 116 may be implemented as appropriate in hardware, software, firmware, or combinations thereof. Software or firmware implementations of the processor(s) 116 may include computer-executable or machine-executable instructions written in any suitable programming language to perform the various functions described.

Memory 114 may store program instructions that are loadable and executable on the processor(s) 116, as well as data generated during the execution of these programs. Depending on the configuration and type of controller device 112, memory 114 may be volatile (such as random access memory (RAM)) and/or non-volatile (such as read-only memory (ROM), flash memory, etc.). The computing device or server may also include additional removable storage 118 and/or non-removable storage 120 including, but not limited to, magnetic storage, optical disks, and/or tape storage. The disk drives and their associated computer-readable media may provide non-volatile storage of computer-readable instructions, data structures, program modules, and other data for the computing devices. In some implementations, the memory 114 may include multiple different types of memory, such as static random access memory (SRAM), dynamic random access memory (DRAM), or ROM.

Memory 114, removable storage 118, and non-removable storage 120 are all examples of computer-readable storage media. For example, computer-readable storage media may include volatile and non-volatile, removable and non-removable media implemented in any method or technology for storage of information such as computer-readable instructions, data structures, program modules or other data. Memory 114, removable storage 118, and non-removable storage 120 are all examples of computer storage media. Additional types of computer storage media that may be present include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, or any other medium which can be used to store the desired information and which can be accessed by the server or other computing device. Combinations of any of above should also be included within the scope of computer-readable media.

Alternatively, computer-readable communication media may include computer-readable instructions, program modules, or other data transmitted within a data signal, such as a carrier wave, or other transmission.

The controller device 112 may also contain communication connection(s) 122 that allow the controller device 112 to communicate with a stored database, another computing device or server, user terminals, and/or other devices on a network. The controller device 112 may also include input device(s) 124, such as a keyboard, mouse, pen, voice input device, touch input device, etc., and output device(s) 126, such as a display, speakers, printer, etc.

Turning to the contents of the memory 114 in more detail, the memory 114 may include an operating system 128 and one or more application programs or services for implementing the features disclosed herein including a clearance module 130. The clearance module 130 may be configured to control the expansion or contraction of the turbine casing 106 by controlling the heating or cooling of at least a portion of the turbine casing 106 via the one or more thermoelectric elements 110 such that the clearance 108 between the one or more turbine blades 104 and the turbine casing 106 is adjusted due to the expansion or contraction of the turbine casing 106. The clearance module 130 can control the heating or cooling of the one or more thermoelectric elements 110 by controlling the voltage and polarity received by the one or more thermoelectric elements 110 from the power source 132. That is, the heating or cooling of the thermoelectric element 110 is dependent on the polarity of the voltage it receives from the power source 132. In certain embodiments, as power from the power source 132 is increased, the heating or cooling of the turbine casing 106 may increase. Conversely, in other embodiments, as power from the power source 132 is decreased, the heating or cooling of the turbine casing 106 may decrease.

Various instructions, methods and techniques described herein may be considered in the general context of computer-executable instructions, such as program modules, executed by one or more computers or other devices. Generally, program modules include routines, programs, objects, components, data structures, etc., for performing particular tasks or implementing particular abstract data types. These program modules and the like may be executed as native code or may be downloaded and executed, such as in a virtual machine or other just-in-time compilation execution environment. Typically, the functionality of the program modules may be combined or distributed as desired in various embodiments. An implementation of these modules and techniques may be stored on some form of computer-readable storage media.

The example controller device 112 shown in FIG. 1 is provided by way of example only. Numerous other operating environments, system architectures, and device configurations are possible. Accordingly, embodiments of the present disclosure should not be construed as being limited to any particular operating environment, system architecture, or device configuration.

Figure 2:
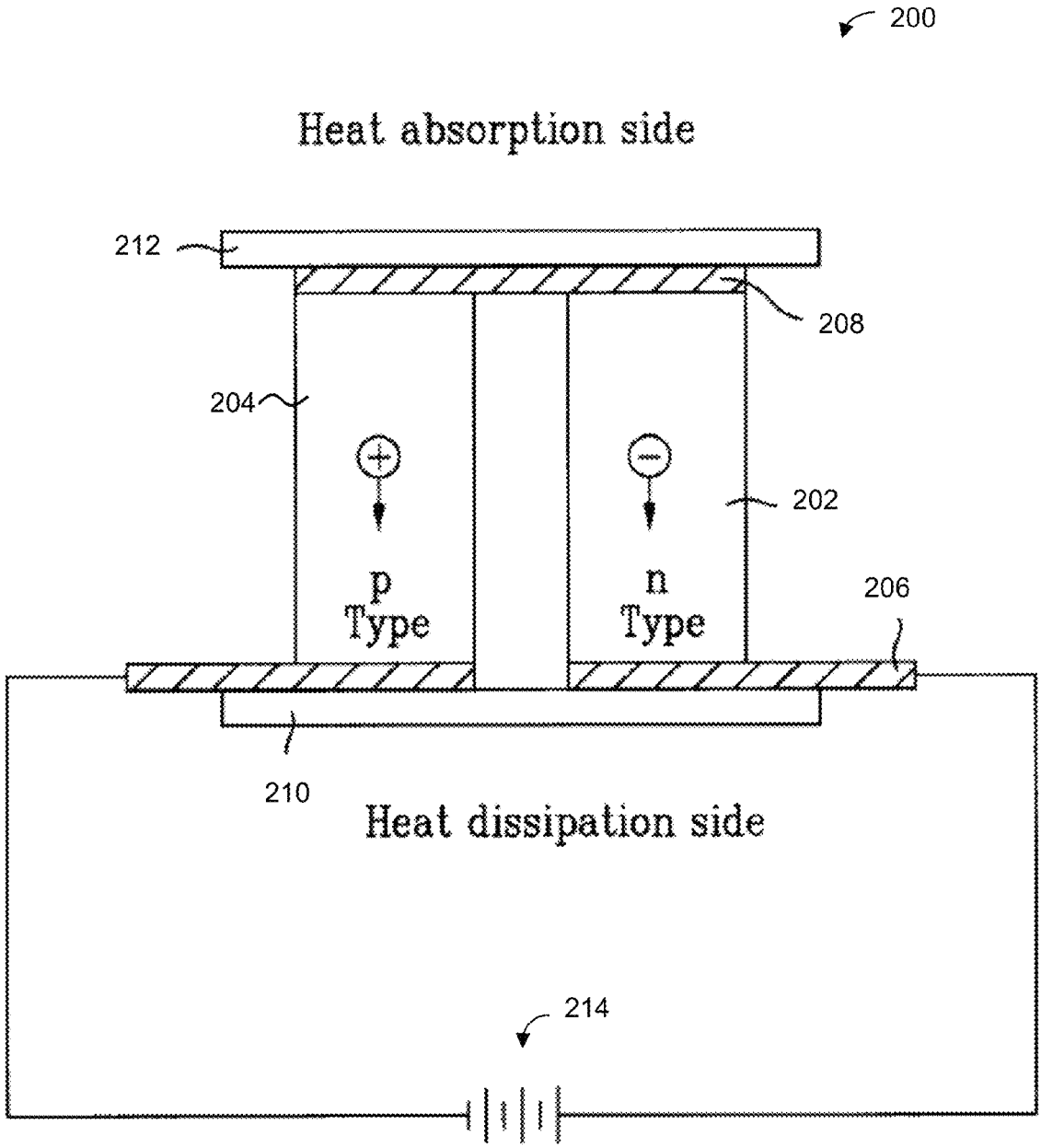
FIG. 2 is a schematic illustrating details of an example thermoelectric element, according to an embodiment of the invention.

FIG. 2 is a schematic illustrating details of an example thermoelectric element 200. In certain embodiments, the thermoelectric element 200 may include at least one Peltier element or may include a component employing or otherwise implementing the Peltier effect. For example, the thermoelectric element 200 may include a semiconductor 202 doped with N-type impurity ions and a semiconductor 204 doped with P-type impurity ions. The N-type and P-type doped semiconductor elements 202 and 204 may be connected together by conductors 206 and 208 to form a serial electronic circuit and a parallel thermal circuit. Heat transfer substrates 210 and 212 may enclose the conductors 206 and 208, respectively. The heat transfer substrates 210 and 212 may be cold sinks or heat sinks depending on the polarity of the thermoelectric element 200.

As is known in Peltier-type thermoelectric elements, the application of a current 214 to the thermoelectric element 200 facilitates localized heating and/or cooling in the junctions and/or conductors as the energy difference in the Peltier-type thermoelectric element becomes converted to heat or cold. Accordingly, the thermoelectric element 200 can be arranged such that heating occurs in one location and cooling in another and vice versa.

The heat transfer substrates 210 and 212 may be a cold sink or heat sink depending on the polarity of the voltage applied to the thermoelectric element 200. For example, as depicted in FIG. 2, the heat transfer substrate 212 is a cold sink, and the heat transfer substrate 210 is a heat sink. In other embodiments, the heat transfer substrate 212 may be a heat sink, and the heat transfer substrate 210 may be a cold sink.

Figure 3:
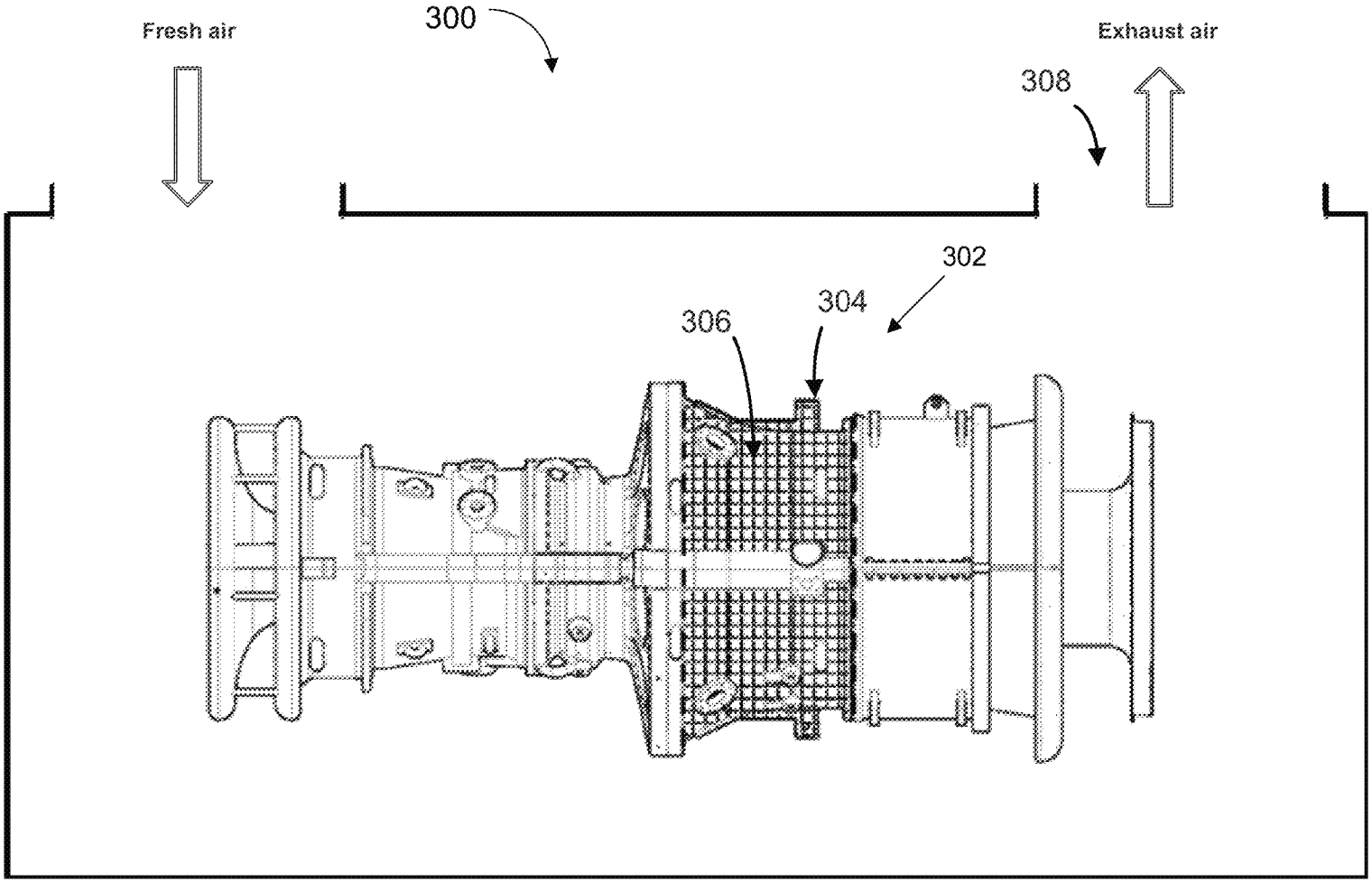
FIG. 3 is a schematic illustrating an example turbine system, according to an embodiment of the invention.

FIG. 3 is a schematic illustrating an example turbine system 300. The turbine system 300 may include a turbine 302. The turbine 302 may include a turbine casing 304. The turbine system 300 may also include a thermoelectric element 306 disposed at least partially about the turbine casing 304. The thermoelectric element 306 heats or cools a portion of the turbine casing 304 in communication with the thermoelectric element 306. The heating and cooling of the turbine casing 304 by the thermoelectric element 306 expands or contracts at least a portion of the turbine casing 304, respectively. The expansion and contraction of the turbine casing 304 adjusts the clearance between the one or more turbine blades and the turbine casing 304. The thermoelectric element 306 may be in communication with a ventilation system 308. For example, when in a cooling mode, the thermoelectric element 306 may include an outer heat sink portion 111 as depicted in FIG. 1. The heat sink portion may dissipate heat transferred from the turbine casing 304 into the surrounding environment. The ventilation system 308 may direct the dissipated heat from the heat sink portion of the thermoelectric element 306 to a remote location where the heat may be recycled or discarded.

Figure 4:
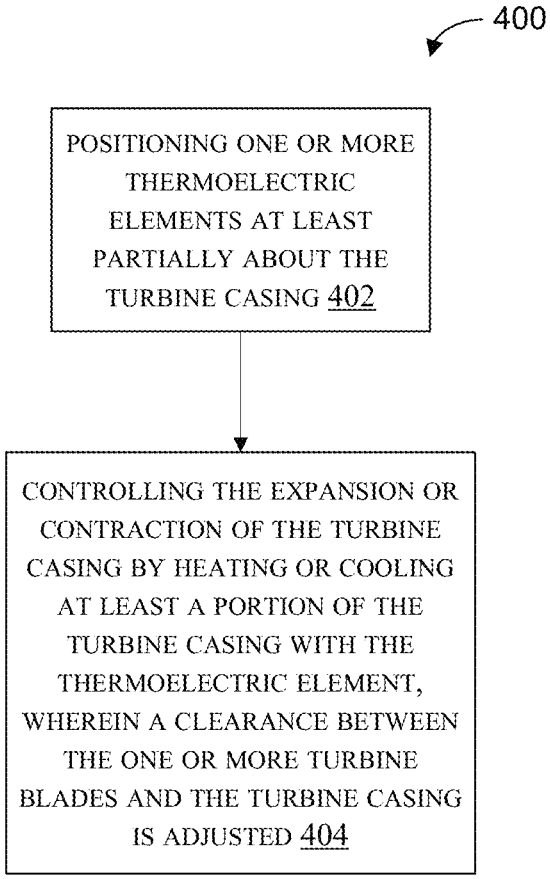
FIG. 4 is a flow diagram illustrating details of an example method for adjusting clearances in a turbine, according to an embodiment of the invention.

FIG. 4 illustrates an example flow diagram of a method 400 for adjusting clearances in a turbine, according to an embodiment of the invention. In one example, the illustrative controller device 112 of FIG. 1 and/or one or more modules of the illustrative controller device 112, alone or in combination, may perform the described operations of the method 400.

In this particular implementation, the method 400 may begin at block 402 of FIG. 4 in which the method 400 may include positioning one or more thermoelectric elements at least partially about the turbine casing. The one or more thermoelectric elements may be position inline with the one or more turbine blades or adjacent to the one or more turbine blades. Moreover, the one or more thermoelectric elements may by positioned about the entire circumference of the turbine casing or only a portion of the circumference of the turbine casing. The one or more thermoelectric elements may be positioned at any location and in any pattern on or about the turbine casing.

Block 402 is followed by block 404. At block 404, the method 400 may include controlling the expansion or contraction of the turbine casing by heating or cooling at least a portion of the turbine casing with the one or more thermoelectric elements, wherein a clearance between the one or more turbine blades and the turbine casing is adjusted. For example, in certain embodiments, the method 400 reduces the clearance between the one or more turbine blades and the turbine casing to increase efficiency during operation, i.e., the turbine casing may be cooled to contract it about the one or more turbine blades. In another embodiment, the method 400 increases the clearance between the one or more turbine blades and the turbine casing to increase efficiency during startup, i.e., the turbine casing may be heated to expand it about the one or more turbine blades to allow the one or more turbine blades to expand during startup.

Illustrative systems and methods are described for adjusting clearances in a turbine. Some or all of these systems and methods may, but need not, be implemented at least partially by architectures such as those shown in FIG. 1 above.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A turbine system, comprising:

one or more turbine blades;

a turbine casing encompassing the one or more turbine blades; and a thermoelectric element disposed at least partially about an exterior of the turbine casing, wherein the thermoelectric element expands or contracts the turbine casing by heating or cooling at least a portion of the turbine casing thereby adjusting a clearance between the one or more turbine blades and the turbine casing, wherein the thermoelectric element comprises a Peltier element disposed between a cold sink and a heat sink, wherein the heat sink is in communication with a ventilation system.

2. The system of claim 1, wherein a voltage is applied to the Peltier element to control heat transfer between the cold sink and a heat sink.

3. The system of claim 2, wherein the cold sink and the heat sink are dependent on the polarity of the applied voltage to the Peltier element.

4. The system of claim 1, wherein the cold sink and the heat sink comprise ceramic plates.

5. The system of claim 1, wherein the clearance between the one or more turbine blades and the turbine casing is reduced to increase efficiency during operation.

6. The system of claim 1, wherein the clearance between the one or more turbine blades and the turbine casing is increased to increase the efficiency and the speed of startup.

7. The system of claim 1, wherein the thermoelectric element is disposed circumferentially about at least a portion of the turbine casing in line with the one or more turbine blades.

8. A method for adjusting clearances in a turbine, the turbine comprising a turbine casing encompassing one or more turbine blades, the method comprising:

positioning one or more thermoelectric elements at least partially about an exterior of the turbine casing, wherein the one or more thermoelectric elements comprises a Peltier element disposed between a cold sink and a heat sink, wherein the heat sink is in communication with a ventilation system; and controlling the expansion or contraction of the turbine casing by heating or cooling at least a portion of the turbine casing with the one or more thermoelectric elements, wherein a clearance between the one or more turbine blades and the turbine casing is adjusted.

9. The method of claim 8 wherein a voltage is applied to the Peltier element to control heat transfer between the cold sink and a heat sink.

10. The method of claim 9, wherein the cold sink and the heat sink are dependent on the polarity of the applied voltage to the Peltier element.

11. The method of claim 8, wherein the cold sink and the heat sink comprise ceramic plates.

12. The method of claim 8, wherein the clearance between the one or more turbine blades and the turbine casing is reduced to increase efficiency during operation.

13. The method of claim 8, wherein the clearance between the one or more turbine blades and the turbine casing is increased to increase efficiency during startup.

14. The method of claim 8, wherein the thermoelectric element is disposed circumferentially about at least a portion of the turbine casing in line with the one or more turbine blades.

15. A turbine system, comprising:

one or more turbine blades;

a turbine casing encompassing the one or more turbine blades;

at least one thermoelectric element disposed at least partially about an exterior of the turbine casing, wherein the at least one thermoelectric element comprises a Peltier element dispose between a cold sink and a heat sink, wherein the heat sink is in communication with a ventilation system; and a controller in communication with the at least one thermoelectric element, the controller comprising:

a computer processor; and a memory in communication with the computer processor operable to store computer-executable instructions operable to:

control the expansion or contraction of the turbine casing by heating or cooling at least a portion of the turbine casing with the at least one thermoelectric element, wherein a clearance between the one or more turbine blades and the turbine casing is adjusted.

* * * * *

UNITED STATES PATENT AND TRADEMARK OFFICE

CERTIFICATE OF CORRECTION

PATENT NO. : 9,057,282 B2
APPLICATION NO. : 13/302372
DATED : June 16, 2015
INVENTOR(S) : Chillar et al.

It is certified that error appears in the above-identified patent and that said Letters Patent is hereby corrected as shown below:

On the title page, under item (75) Inventors, please change "Prabhakaran Saraswathi Rajesh, Bangalore, IN (US)" to -- Prabhakaran Saraswathi Rajesh, Bangalore (IN) --.

Signed and Sealed this
Tenth Day of November, 2015

Michelle K. Lee

Michelle K. Lee
*Director of the United States Patent and Trademark Office*